United States Patent [19]

Nuttall et al.

[11] Patent Number: 4,486,268

[45] **Date of Patent: * Dec. 4, 1984**

[54] AIR/WATER HYBRID FORMER

[75] Inventors: David A. Nuttall; Sung Ho Hong, both of Neenah, Wis.

[73] Assignee: Kimberly-Clark Corporation, Neenah, Wis.

[ * ] Notice: The portion of the term of this patent subsequent to Aug. 12, 1999 has been disclaimed.

[21] Appl. No.: 398,026

[22] Filed: Jul. 14, 1982

Related U.S. Application Data

[63] Continuation-in-part of Ser. No. 259,962, May 4, 1981, Pat. No. 4,344,818.

[51] Int. Cl.[3] ..... D21F 11/00

[52] U.S. Cl. ..... 162/123; 162/201

[58] Field of Search ..... 162/123, 125, 129, 132, 162/201, 203

[56] References Cited

U.S. PATENT DOCUMENTS 4,046,622 9/1977 Attwood et al. ..... 162/201

4,344,818 8/1982 Nuttall et al. ..... 162/123

*Primary Examiner*—Peter Chin

*Attorney, Agent, or Firm*—Gregory E. Croft

[57] ABSTRACT

A method and apparatus especially adapted to produce a ply separable web requiring substantially less energy input for drying. The apparatus comprises a headbox having at least three stock flow channels, at least one of which being adapted to convey conventional aqueous stock solutions and at least one other channel adapted to convey airborne fibers. The resulting web, having a significant portion of the fibers in a dry state, requires less energy to dry, and the distinct layers provide shear zones therebetween which permit ply separation upon creping. Different fiber types may be provided in different layers depending upon product attributes desired, and the products may be conventionally dried or may be throughdried. An alternative embodiment requires the mixing of airborne fibers with an aqueous solution adjacent to or within the headbox, producing only surface wetting of the fibers and reduced inter-fiber bonding.

2 Claims, 3 Drawing Figures

AIR/WATER HYBRID FORMER

This application is a continuation-in-part of copending U.S. patent application Ser. No. 259,962, filed May 4, 1981 now U.S. Pat. No. 4,344,818.

BACKGROUND OF THE INVENTION

Paper webs, such as those used in disposable consumer tissue products (facial tissue, bathroom tissue, towels, etc.) have been traditionally made by the fourdrinier process, which involves laying an aqueous solution of fibers and water on a moving foraminous forming fabric, dewatering the web thus formed with a combination of vacuums, heat and pressure, and creping the substantially dry web. Dewatering the web produces stiff hydrogen bonds between adjacent fibers and lends strength to the web, while a subsequent creping process breaks a portion of these bonds and produces favorable tactile properties. Because the stock slurry contains only approximately 0.4% fibers, substantial amounts of energy must be expended in order to remove the water. Typically, the web is dewatered to approximately 15 to 20% fiber consistency while on the forming fabric, primarily by the application of vacuum to the web, with subsequent dewatering taking place between press rolls which bring the fiber consistency up to approximately 40%. Final dewatering may occur on a Yankee drying cylinder which dries the web to approximately 95% consistency. Alternatively, in place of the press rolls and Yankee dryer, a throughdrying cylinder as shown in U.S. Pat. No. 3,303,576, Sisson may be employed, which substantially dries the web prior to its application to a creping cylinder. Because the energy input (in the form of heat) required to remove a given quantity of water from a wet web increases dramatically as the web becomes drier, any method of reducing the amount of water in the sheet which would decrease the drying load would be beneficial in terms of reducing the cost of manufacture for a given quantity of paper webs.

As has been proposed previously, such as in U.S. Pat. No. 4,166,001, Dunning et al, numerous benefits may be derived from a multi-layer web exhibiting ply separation, such as increased bulk and absorbency of the finished product. In the Dunning et al patent it was suggested that forming a three layer web with the two outer layers forming strong inter-fiber bonds and the inner layer being of fibers forming weak inter-fiber bonds would aid in ply separation. The difference in bonding occurred through use of different fiber types, such as using northern softwood fibers with wet strength resin in the outer layers and hardwood fibers with chemical debonders in the inner layer.

It has been proposed in U.S. Pat. No. 3,954,554, Curry et al, to form a multi-ply paper sheet or paperboard by using multiple forming means to form separate plies which are subsequently brought together to form a single product. For example, a fourdrinier-type forming unit forms a first wet-laid web, multiple airlaying forming heads form a second air-laid web which is brought into contact with the first wet-laid web, and a third fourdrinier forming unit forms a second wet-laid web which is thereafter brought into contact with the air-laid web to form a three layer product. It is suggested that the reduced drying load of the machine will permit it to be operated much faster, thereby increasing the efficiency of the process.

SUMMARY OF THE INVENTION

In the present invention, there is a headbox for forming a multi-layer ply separable web preferably comprising first and second flow channels for providing outer layers of an aqueous slurry of papermaking fibers, and a third flow channel intermediate the first and second flow channels for providing an air-laid layer of fibers between the outer aqueous layers of fibers. The first and second outer flow channels may be interconnected to a common fiber stock supply, or may be provided with dissimilar fiber stocks. Alternatively, the headbox may be provided with means to mix airborne fibers with an aqueous solution within or adjacent to the headbox such that the fibers will be surface wetted only before exiting from the headbox.

The web formed by the preferred method of the present invention may exhibit ply separability between adjacent layers upon creping, thereby increasing the bulk and absorbency of the finished product. The web may be formed with a single inner layer of fibers, or it may be provided with two or more inner layers, at least one of which comprises airborne fibers. Cellulosic or synthetic fibers may be utilized in various combinations in the layers of the web produced by the present invention.

In alternative embodiments, the multi-layer web can be provided with an outer layer or layers of air-laid fibers to impart good texture and feel to the outer layer(s). Using a three channel inlet, for example, the two outer layers can be air-laid fibers with an inner layer of either water or an aqueous slurry of papermaking fibers. The two outer layers of air-laid fibers can provide the texture and feel to the product and the inner layer can provide the hydrogen bonding necessary to hold the product together. In addition, multiple-channel headboxes can be used to produce products having more than three layers, using any combination of airborne, water-borne, or water layers. Such a product can be made having the first, third, and fifth layers containing air-laid fibers and the second and fourth layers containing water-borne fibers or simply just water alone.

DESCRIPTION OF THE PREFERRED EMBODIMENT

Figure 1:
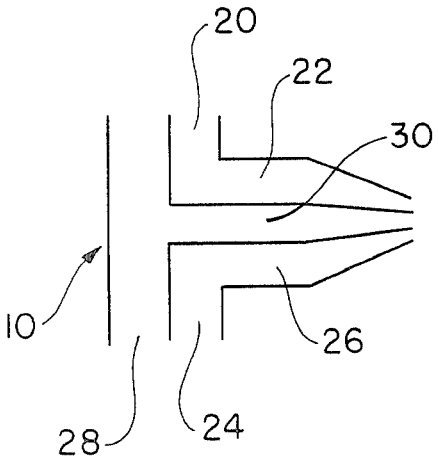
FIG. 1 is a schematic representation of a preferred three layer headbox of the present invention.

Referring to FIG. 1, a headbox, generally designated 10 is illustrated which is adapted to produce the web of the present invention. A first aqueous stock supply means 20 is interconnected to a stock preparation means (not shown) which provide an aqueous stock solution to flow chamber 22, the stock exiting therefrom becoming a first outer layer of fibers in the resulting web. A second aqueous stock supply means 24, interconnected either to the same stock preparation system as first stock supply means 20, or to a stock preparation system containing a different fiber type, supplies fibers in an aqueous solution to a second flow chamber 26 from which exits fibers forming a second outer layer of the resulting web product. A third stock supply means 28 is adapted to provide airborne fibers to a third flow chamber 30. A stock preparation system (not shown) which would provide sufficient quantities of airborne fibers is illustrated in U.S. Pat. No. 3,976,734, Dunning et al. The fibers issuing from the third flow chamber 30 are positioned intermediate the fibers exiting flow chambers 22 and 26 and become the inner layer of fibers in the resulting web product.

Figure 2:
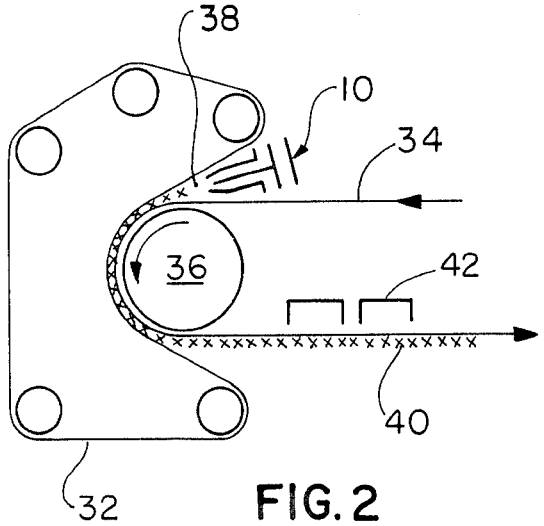
FIG. 2 is a representation of a headbox shown in FIG. 1 utilized in conjunction with a twin-wire forming papermaking machine.
Figure 3:
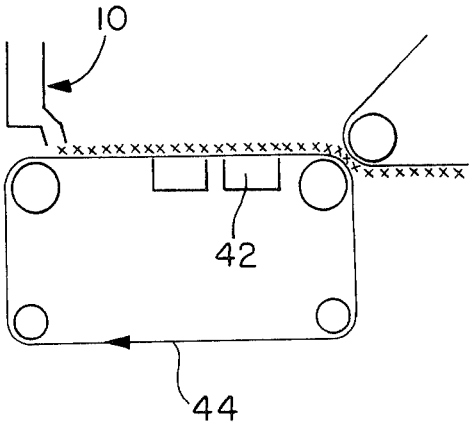
FIG. 3 is a representation of a headbox of FIG. 1 utilized with a fourdrinier-type papermaking machine.

Headbox 10 may take any desirable form, depending upon the circumstances to which it will be utilized. As illustrated in FIG. 2, a twin wire forming system, wherein an outer forming wire 32 and an inner fabric 34 are directed about forming roll 36, is a preferred environment for headbox 10. The headbox 10 is positioned so that the fibers exiting therefrom will be injected into the nip 38 formed between converging fabrics 32 and 34. The web 40 issuing therefrom may be dewatered initially by one or more vacuum boxes 42 prior to the final drying. Alternatively, as shown in FIG. 3, the headbox 10 may be positioned above a fourdrinier-type foraminous forming wire 44 and initially dewatered by vacuum boxes 42.

When a web formed from a headbox of FIG. 1 is dried, either by conventional drying processes or by "throughdrying", the energy input into a given quantity of the web will be substantially less than the amount of energy required to dry a prior art layered web. Fibers introduced in an air stream through flow chamber 30 since they will reduce the water load on the forming section will not need to be dried, thereby permitting the papermaking machine upon which the web is formed to be operated at a faster speed, or permitting operation at the same speed with substantially decreased energy requirements for drying.

The fiber types utilized in the outer wet-laid layers may be chosen depending upon the attributes desired in the finished product. For example, if a highly bonded outer layer is desired for strength, northern softwood kraft or sulfite fibers may be utilized with a wet strength resin (such as Kymene®), or if a pulp having substantially less bonding capacity is desired, southern hardwood kraft with or without a chemical debonding agent may be utilized. In the case of a single ply tissue product, both outer layers may advantageously be comprised of northern softwood kraft whereas for a two ply product, one outer layer may be comprised of the high bonding softwood while another outer layer (which, when mated with a second tissue web to form a two ply product, becomes an "inner" layer) may comprise lower bonding hardwood fibers. In either case, with airborne fibers injected between the layers of wet laid fibers, distinct "shear zones" will be formed at the interfaces between the inner and outer layers. Upon creping, the differential bonding of the adjacent layers will permit the layers to separate from one another at the shear zone, thereby increasing the bulk and absorbency of the resulting web.

The apparatus and method of the present invention may be particularly suited to forming heavier-basis weight products, such as disposable towels in the 25–40 pounds per 2880 square foot range. Because of the heavy basis weights involved, creping such webs to disrupt papermaking bonds is somewhat less effective than the creping of lighter basis weight webs since the crepe cannot "strike through" the entire sheet. However, with the distinct shear zones between the various layers, the energy put into the creping action can more easily disrupt the fibers in the inner portion of the web, thereby increasing the bulk and absorbent capacity of the finished product. In the higher basis weights, it may be desirable or necessary to crepe both sides of the web in order to obtain maximum product qualities.

A web made according to the present invention is provided with a number of the most beneficial attributes of both wet laid and air-laid webs. As with air-laid webs, the energy required for drying is substantially reduced, but the problems associated with "linting" of air-laid webs (caused by unattached fibers being shed from the web) is eliminated because the air-laid fibers are constrained within wet laid layers. Additionally, whereas cross-machine direction uniformity is difficult to maintain in air-laid webs, such nonuniformities will be masked by the outer wet laid layers.

While it is envisioned that the products produced according to the present invention will be comprised primarily of cellulosic fibers, artificial fibers may advantageously be incorporated within the scope of the present invention. For instance, the use of synthetic fibers in the inner layers, whether or not these fibers are suspended in an air or water medium, will produce a very lightly bonded inner layer. Such fibers conveyed in an aqueous medium will exhibit very little bonding due to the lack of hydrogen bonding between such fibers. Synthetic fibers may be mixed with cellulosic fibers in the outer layers, or one layer may be composed of synthetic fibers while the other contains cellulosic fibers.

If the intent is to produce a ply separable web, without attempting to reduce the drying load, fibers may be conveyed in an air stream either into or adjacent the headbox, and then mixed in an aqueous solution immediately prior to being expelled from the headbox. In this manner, the fibers will not absorb water but will be formed in an aqueous solution, thereby increasing the uniformity of the layer and increasing somewhat the bonding between the fibers. However, the bonding will be significantly less than that in premixed aqueous stock because the fibers were surface wetted only and substantially fewer hydrogen bonds will form between adjacent fibers. Additionally, because the water was not absorbed into the fibers, less energy will be required to remove it from the fiber surface.

It has been proposed that one function of a layered paper web may be to "hide" inexpensive undesirable fibers in an inner layer while having outer layers comprised of more desirable, expensive fibers. Usually, these undesirable fibers are shorter than papermaking fibers, either because they have been recycled and damaged, because they originate in an undesired pulp tree species, or because they result from damage during processing (i.e. paper "dust"). In any case, the dry fibers of the inner layer are not limited by minimum size constraints, since they will be "encapsulated" between the two aqueous flows of the outer layers.

It is to be understood that, while the foregoing description has concerned a three layer web, a web having two or more inner layers, all or some of which may comprise airborne fibers, are within the scope of this description. It is to be further understood that the invention is not to be limited to the specific construction, arrangements and devices shown and described, except only insofar as to claims may be so limited, as it will be understood to those skilled in the art that changes may be made without departing from the principles of the present invention.

What is claimed is:

1. A method of forming a multi-layer absorbent web from a single headbox comprising:

(a) forming a first outer layer of papermaking fibers, said fibers being provided from a first flow channel of said headbox and being entrained in an air stream and having reduced inter-fiber hydrogen bonding therebetween;

(b) forming an inner layer of fibers, said fibers in said inner layer being provided in an aqueous fiber stock slurry from a second flow channel of said headbox;

(c) forming a second outer layer of papermaking fibers entrained in an air stream and having reduced inter-fiber bonding therebetween provided from a third flow channel of said headbox; and (d) dewatering said inner layer of fibers such that significant inter-fiber hydrogen bonds are formed between fibers within said layer.

2. A method of forming a multi-layer absorbent web from a single headbox comprising:

(a) forming a first outer layer of papermaking fibers, said fibers being provided from a first flow channel of said headbox and being entrained in an air stream and having reduced inter-fiber hydrogen bonding therebetween;

(b) forming an inner layer of water, substantially free of fibers, provided from a second flow channel of said headbox;

(c) forming a second outer layer of papermaking fibers, said fibers being provided from a third flow channel of said headbox and being entrained in an air stream and having reduced inter-fiber hydrogen bonding therebetween; and (d) dewatering the web such that significant inter-fiber hydrogen bonds are formed between fibers of the two outer layers.

* * * * *